US011707148B2

(12) United States Patent
Meredith

(10) Patent No.: US 11,707,148 B2
(45) Date of Patent: Jul. 25, 2023

(54) SURFACE MOUNTABLE STORAGE ASSEMBLY

(71) Applicant: Candrassa Meredith, Marrero, LA (US)

(72) Inventor: Candrassa Meredith, Marrero, LA (US)

( * ) Notice: Subject to any disclaimer, the term of this patent is extended or adjusted under 35 U.S.C. 154(b) by 193 days.

(21) Appl. No.: 17/171,724

(22) Filed: Feb. 9, 2021

(65) Prior Publication Data

US 2022/0248886 A1 Aug. 11, 2022

(51) Int. Cl.

| | |
|---|---|
| ***B65D 33/14*** | (2006.01) |
| ***A47G 29/08*** | (2006.01) |
| ***B65D 33/28*** | (2006.01) |
| ***B65D 33/04*** | (2006.01) |

(52) U.S. Cl.

CPC ..... *A47G 29/08* (2013.01); *B65D 33/04* (2013.01); *B65D 33/14* (2013.01); *B65D 33/28* (2013.01)

(58) Field of Classification Search

CPC ..... A45C 13/002; A45C 2200/10; A45C 3/08; A45C 2011/002; B65D 33/14; B65D 33/04; B65D 33/28; A47G 29/08

USPC ..... 383/6, 11, 41, 106, 22–24, 66, 71–76; 150/154; 224/904, 269, 660, 666, 929, 224/930, 901; 248/311.2; 220/480–483

See application file for complete search history.

(56) References Cited

U.S. PATENT DOCUMENTS

| | | | | |
|---|---|---|---|---|
| 3,063,570 | A | 11/1962 | Kroner | |
| D337,016 | S | 7/1993 | Fortescue | |
| 5,533,809 | A * | 7/1996 | Gorman | H01H 9/025 206/320 |
| 5,899,420 | A | 5/1999 | Gerardi | |
| D578,802 | S | 10/2008 | Russell | |
| 7,686,172 | B2 | 3/2010 | Wisnoski | |
| 7,810,655 | B2 | 10/2010 | Wang | |
| D704,959 | S | 5/2014 | Callif | |
| 8,807,376 | B1 * | 8/2014 | Mastors | A61M 5/1414 220/751 |
| 2006/0049124 | A1 | 3/2006 | Wang | |

FOREIGN PATENT DOCUMENTS

| | | |
|---|---|---|
| WO | WO2017083197 | 5/2017 |

* cited by examiner

*Primary Examiner* — Jes F Pascua
*Assistant Examiner* — Nina K Attel

(57) ABSTRACT

A surface mountable storage assembly for storing and organizing purses and handbags includes a housing, which defines an interior space. The housing has a top, which is open, and a front, which has an aperture positioned therein. Contents, such as purses and handbags, can be inserted into the housing through the top. A panel is engaged to the housing and extends over the aperture. The panel is substantially transparent so that the contents of the housing are visible therethrough. A fastener engaged to a back of the housing engages a surface to mount the housing thereto.

9 Claims, 4 Drawing Sheets

SURFACE MOUNTABLE STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storage assemblies and more particularly pertains to a new storage assembly for storing and organizing purses and handbags.

(2) Description of Related Art Including Information Disclosed Under 37 CFR 1.97 and 1.98

The prior art relates to storage assemblies. Prior art storage assemblies for handbags may comprise surface mountable shelves and bins, which may be vertically mounted. Prior art storage assemblies also may comprise hanging organizers with multiple slots, and straps having a plurality of hooking elements engaged thereto. What is lacking in the prior art is a storage assembly comprising a deformable housing incorporating a clear panel and having a closable shell engaged thereto, for viewing and sealably protecting the contents, respectively.

BRIEF SUMMARY OF THE INVENTION

An embodiment of the disclosure meets the needs presented above by generally comprising a housing, which defines an interior space. The housing has a top, which is open, and a front, which has an aperture positioned therein. The housing is configured for insertion of contents, such as purses and handbags, thereinto through the top. A panel is engaged to the housing and extends over the aperture. The panel is substantially transparent so that the contents of the housing are visible therethrough. A fastener engaged to a back of the housing is configured to engage a surface to mount the housing thereto.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
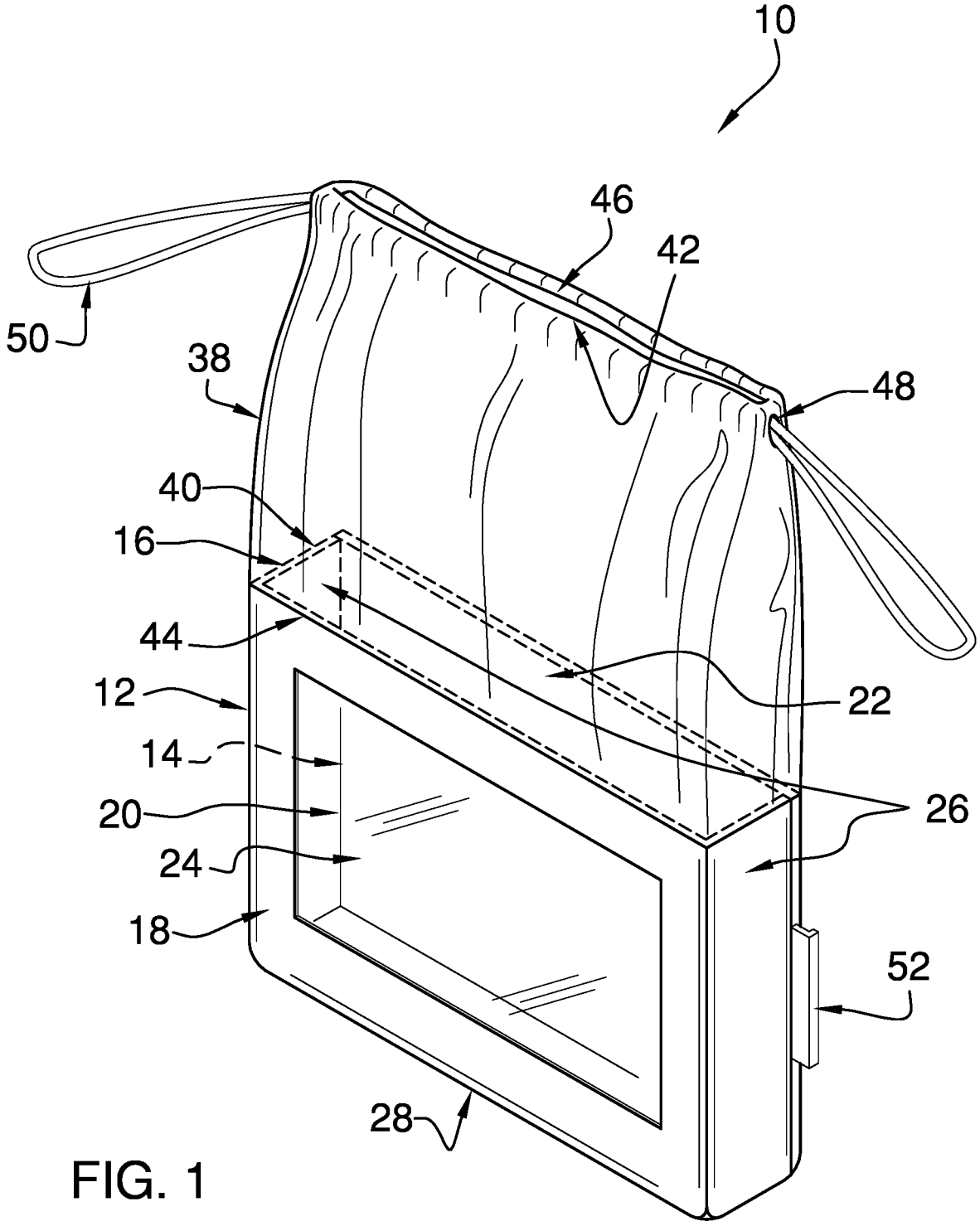
FIG. 1 is an isometric perspective view of a surface mountable storage assembly according to an embodiment of the disclosure.

With reference now to the drawings, and in particular to FIGS. 1 through 4 thereof, a new storage assembly embodying the principles and concepts of an embodiment of the disclosure and generally designated by the reference numeral 10 will be described.

As best illustrated in FIGS. 1 through 4, the surface mountable storage assembly 10 generally comprises a housing 12, which defines an interior space 14. The housing 12 has a top 16, which is open, a front 18, which has an aperture 20 positioned therein, and a back 22, which is rigid and thus fixedly planar. The housing 12 is configured for insertion of contents, such as purses and handbags, thereinto through the top 16.

A panel 24 is engaged to the housing 12 and extends over the aperture 20. The panel 24 is substantially transparent so that the contents of the housing 12 are visible therethrough. The panel 24, the front 18, opposed sides 26 and a bottom 28 of the housing 12 are resiliently deformable so that the housing 12 can flexibly adjust to the contents positioned therein. The panel 24, the front 18, the opposed sides 26, and the bottom 28 comprise elastomer.

Figure 2:
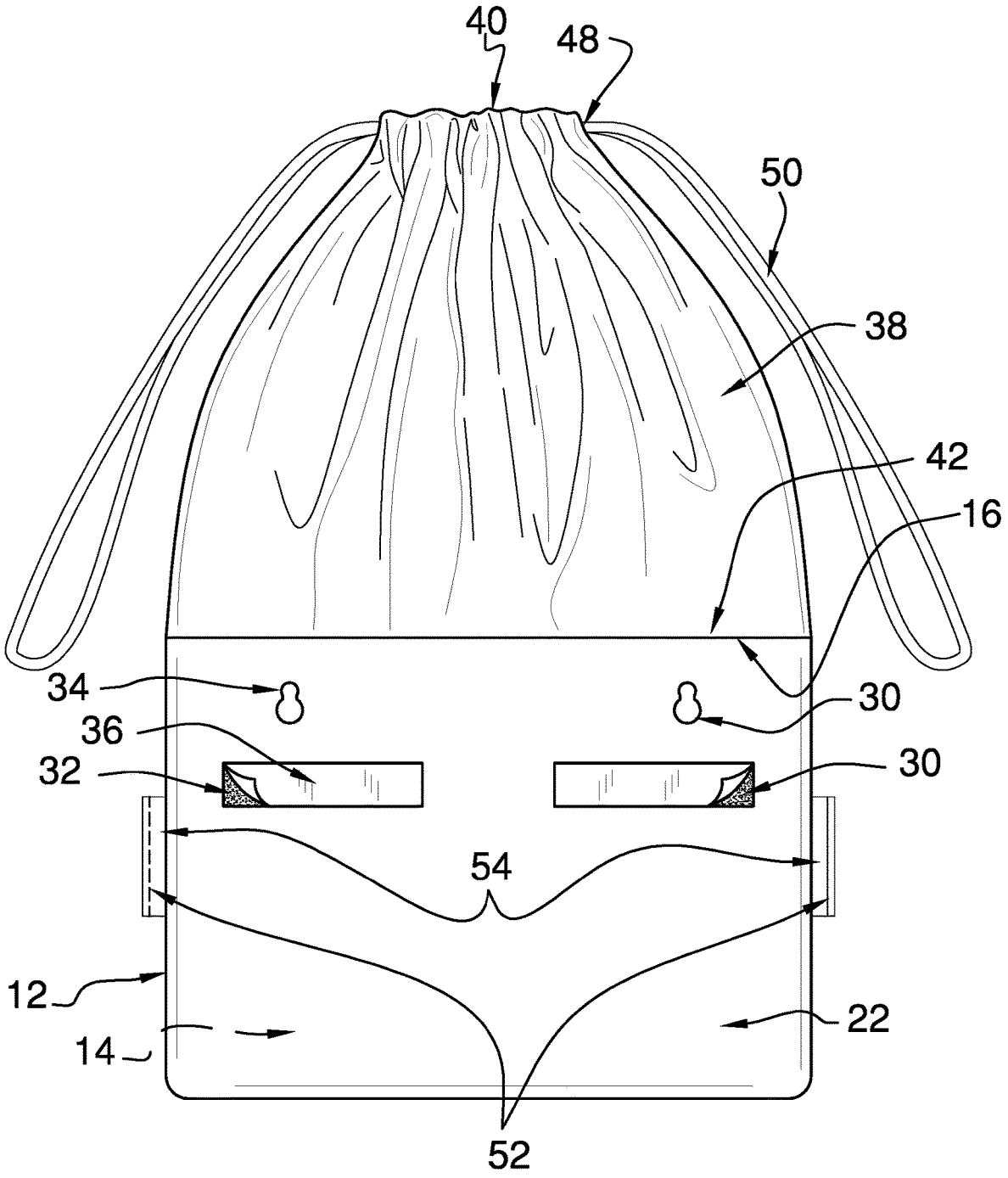
FIG. 2 is a back view of an embodiment of the disclosure.

A fastener 30 engaged to the back 22 of the housing 12 is configured to engage a surface, such as a door or wall in a closet, to mount the housing 12 thereto. The fastener 30 may comprise an adhesive strip 32 or a keyhole slot 34, or both, as shown in FIG. 2. The fastener 30 also may comprise other fastening means, such as, but not limited to, hook and loop fasteners, suction cups, and the like. The adhesive strip 32 is configured to adhesively engage the surface to mount the housing 12 thereto. The keyhole slot 34 is configured for insertion of an article of mounting hardware (not shown), such as a screw or hook, which extends from the surface to mount the housing 12 thereto.

The adhesive strip 32 has a cover strip 36 removably engaged thereto. The cover strip 36 is selectively removable from the adhesive strip 32 for mounting of the housing 12 to the surface. The cover strip 36 is configured to prevent inadvertent adhesion of the adhesive strip 32, such as in an instance where the keyhole slot 34 is being used to mount the housing 12.

The assembly 10 also comprises a shell 38, which is tubular. The shell 38 has an upper limit 40 and a lower limit 42, which are open. The lower limit 42 of the shell 38 is engaged to a perimeter 44 of the top 16 of the housing 12. The shell 38 comprises elastomer so that the shell 38 is resiliently deformable.

A sleeve 46 is engaged to the upper limit 40 of the shell 38. The sleeve 46 has a slit 48 positioned therein. A drawstring 50 positioned in the sleeve 46 and extends from the slit 48. The shell 38 is configured for insertion of the contents therethrough into the housing 12. The drawstring 50 is configured to be drawn to close the upper limit 40 of the sleeve 46 so that the contents are substantially sealed within the housing 12 and the shell 38. The shell 38 is substantially transparent.

Figure 3:
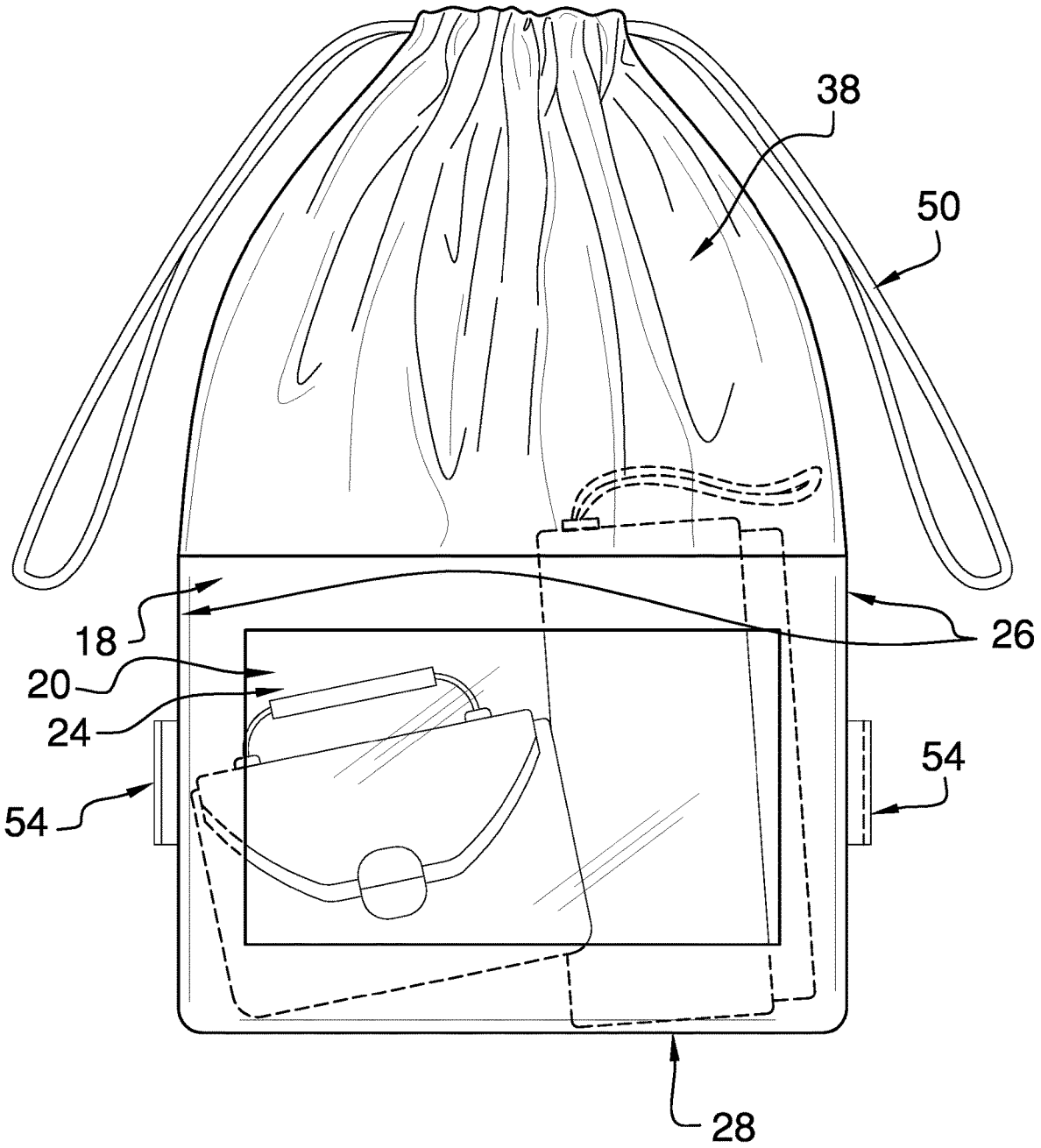
FIG. 3 is a front view of an embodiment of the disclosure.
Figure 4:
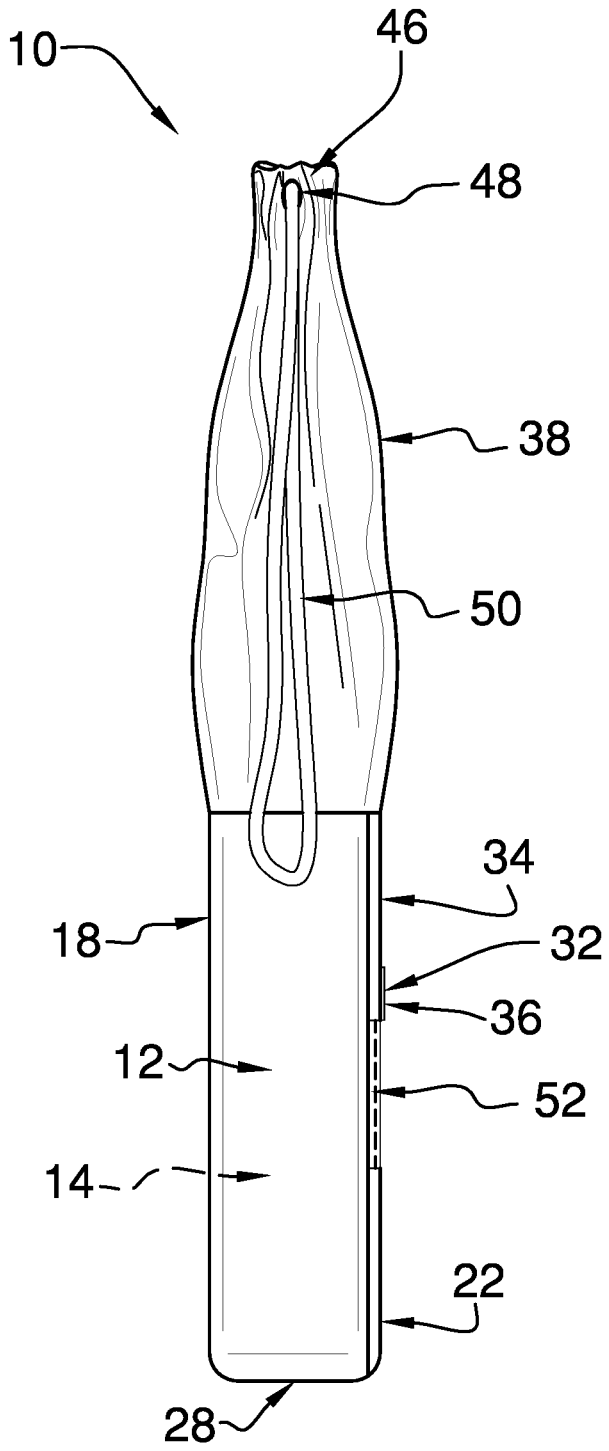
FIG. 4 is a side view of an embodiment of the disclosure.

The housing 12 is one of a set of housings 12. Each housing 12 has a pair of connectors 52 engaged to the back 22 thereof and extending singly from the opposed sides 26. The connectors 52 are selectively mutually couplable. Thus, a respective connector 52 engaged to one of the housings 12 is positioned to selectively engage a respective connector 52 engaged to another of the housings 12 so that the housings 12 are mutually engaged. As shown in FIGS. 2 and 3, the pair of connectors 52 comprises a pair of brackets 54. One of the brackets 54 faces the front 18 while the other of the brackets 54 faces the back 22. The one of the brackets 54 facing the back 22 of one of the housings 12 is slidably insertable into the one of the brackets facing the front 18 on another of the housings 12.

In use, the housing 12 is mounted to the surface, such as an unused wall area of a closet or an inner face of a closet door, using the fastener 30. Handbags and purses can be positioned in the housing 12 by inserting them through the shell 38 and the top 16 of the housing 12. The drawstring 50 is drawn to close the upper limit 40 of the shell 38, thereby sealing the handbags and purses in the housing 12 and shell 38. The contents of the housing 12 are visible through the panel 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A surface mountable storage assembly comprising:

a housing defining an interior space, the housing having a top and a front, the top being open, wherein the housing is configured for insertion of contents thereinto, the front having an aperture positioned therein;

a panel engaged to the housing and extending over the aperture, the panel being substantially transparent, such that the contents of the housing are visible therethrough; and a fastener engaged to a back of the housing and being configured for engaging a surface for mounting the housing thereto;

a shell, the shell being tubular, the shell having an upper limit and a lower limit, the upper limit and the lower limit being open, the lower limit being engaged to a perimeter of the top of the housing, the shell comprising elastomer such that the shell is resiliently deformable;

a sleeve engaged to the upper limit of the shell, the sleeve having a slit positioned therein; and a drawstring positioned in the sleeve and extending from the slit, wherein the shell is configured for insertion of the contents therethrough into the housing, wherein the drawstring is configured for closing the upper limit of the sleeve, such that the contents are substantially sealed within the housing and the shell.

2. The surface mountable storage assembly of claim 1, wherein:

the back of the housing is rigid; and the panel, the front, opposed sides of the housing, and a bottom of the housing are resiliently deformable, such that the housing can flexibly adjust to contents positioned therein.

3. The surface mountable storage assembly of claim 2, wherein the panel, the front, the opposed sides, and the bottom comprise elastomer.

4. The surface mountable storage assembly of claim 1, wherein the fastener comprises an adhesive strip or a keyhole slot, wherein the adhesive strip is configured for adhesively engaging the surface for mounting the housing thereto, wherein the keyhole slot is configured for insertion of an article of mounting hardware extending from the surface for mounting the housing thereto.

5. The surface mountable storage assembly of claim 4, further including the adhesive strip having a cover strip removably engaged thereto, such that the cover strip is selectively removable therefrom for mounting the housing to the surface, wherein the cover strip is configured for preventing inadvertent adhesion of the adhesive strip.

6. The surface mountable storage assembly of claim 1, wherein the shell is substantially transparent.

7. A surface mountable storage assembly comprising:

a set of housings, each housing defining an interior space, each housing having a top and a front, the top being open, wherein each housing is configured for insertion of contents thereinto, the front having an aperture positioned therein;

a panel engaged to each housing and extending over each respective aperture, the panel being substantially transparent, such that the contents of each housing are visible therethrough;

a fastener engaged to a back of each housing and being configured for engaging a surface for mounting each housing thereto; and each housing having a pair of connectors engaged to the back thereof and extending singly from opposed sides thereof, the connectors being selectively mutually couplable, such that a respective connector engaged to one of the housings is positioned for selectively engaging a respective connector engaged to another of the housings, such that the housings are mutually engaged.

8. The surface mountable storage assembly of claim 7, wherein the pair of connectors comprises a pair of brackets, one of the brackets facing the front, the other of the brackets facing the back, such that the one of the brackets facing the back of the one of the housings is slidably insertable into the one of the brackets facing the front of the another of the housings.

9. A surface mountable storage assembly comprising:

a set of housing, each housing defining an interior space, each housing having a top and a front, the top being open, wherein each housing is configured for insertion of contents thereinto, the front having an aperture positioned therein, a back of each housing being rigid, the front, opposed sides of each housing, and a bottom of each housing being resiliently deformable, such that each housing can flexibly adjust to contents positioned therein, the front, the opposed sides, and the bottom comprising elastomer;

each housing of the set of housings further comprising:

a panel engaged to the housing and extending over the aperture, the panel being substantially transparent, such that the contents of the housing are visible therethrough, the panel comprising elastomer, such that the panel is resiliently deformable;

a fastener engaged to the back of the housing and being configured for engaging a surface for mounting the housing thereto, the fastener comprising:

an adhesive strip configured for adhesively engaging the surface for mounting the housing thereto, wherein the adhesive strip has a cover strip removably engaged thereto, such that the cover strip is selectively removable therefrom for mounting the housing to the surface, wherein the cover strip is configured for preventing inadvertent adhesion of the adhesive strip; or a keyhole slot configured for insertion of an article of mounting hardware extending from the surface for mounting the housing thereto;

a shell, the shell being tubular, the shell having an upper limit and a lower limit, the upper limit and the lower limit being open, the lower limit being engaged to a perimeter of the top of the housing, the shell comprising elastomer such that the shell is resiliently deformable, the shell being substantially transparent;

a sleeve engaged to the upper limit of the shell, the sleeve having a slit positioned therein;

a drawstring positioned in the sleeve and extending from the slit, wherein the shell is configured for insertion of the contents therethrough into the housing, wherein the drawstring is configured for closing the upper limit of the sleeve, such that the contents are substantially sealed within the housing and the shell; and a pair of connectors engaged to the back of the housing and extending singly from the opposed sides, the connectors being selectively mutually couplable, such that a respective connector engaged to one of the housings is positioned for selectively engaging a respective connector engaged to another of the housings, such that the housings are mutually engaged, the pair of connectors comprising a pair of brackets, one of the brackets facing the front, the other of the brackets facing the back, such that the other of the brackets facing the back of the one of the housings is slidably insertable into the one of the brackets facing the front of the another of the housings.

* * * * *